US005852852A

United States Patent [19]

Rigal

[11] Patent Number: 5,852,852

[45] Date of Patent: Dec. 29, 1998

[54] TIGHTENING DEVICE WITH SERRATED STRAP AND RATCHET LOCKING MEMBER

[75] Inventor: Jean-Pierre Rigal, La Balme De Sillingy, France

[73] Assignee: Salomon S.A., Metz-Tessy, France

[21] Appl. No.: 871,667

[22] Filed: Jun. 9, 1997

[30] Foreign Application Priority Data

Jun. 13, 1996 [FR] France ..... 96 07595

[51] Int. Cl.[6] ..... A43C 11/00

[52] U.S. Cl. ..... 24/68 R; 24/68 SK; 24/170; 24/191

[58] Field of Search ..... 24/68 R, 68 SK, 24/68 CD, 191, 170

[56] References Cited

U.S. PATENT DOCUMENTS

| | | | |
|---|---|---|---|
| 3,253,309 | 5/1966 | Baresch | 24/170 |
| 3,608,158 | 9/1971 | Bengtsson | 24/170 |
| 4,433,458 | 2/1984 | Olivieri | 24/191 |
| 4,683,620 | 8/1987 | Valsecchi et al. | 24/68 SK |
| 5,416,952 | 5/1995 | Dodge | 24/68 R |
| 5,480,176 | 1/1996 | Sims | 280/618 |

FOREIGN PATENT DOCUMENTS

| | | | |
|---|---|---|---|
| 379297 | 12/1985 | Austria . | |
| 0161441 | 11/1985 | European Pat. Off. . | |
| 1204470 | 1/1960 | France | 24/191 |
| WO95/19205 | 7/1995 | WIPO . | |

*Primary Examiner*—Victor N. Sakran
*Attorney, Agent, or Firm*—Greenblum & Bernstein, P.L.C.

[57] ABSTRACT

The invention relates to a tightening device including a strap portion provided with a serrated portion and with a tightening element, such as band or flap, on which is mounted a locking member including a base fixed on the tightening element; a ratchet connected to the base by a journal and having at least one complementary retaining serrated portion adapted to cooperate with the serrated portion of the strap portion; an elastic return device which maintains the serrated portions in contact with one another in the locking position; and a lever that can be actuated against the force exerted by the elastic return device for disengaging the serrated portions, wherein the strap portion engages through the locking member into a space provided between the journal and a complementary retaining serrated portion of the ratchet. The complementary retaining serrated portion of the ratchet is located with respect to the journal on the side where the strap portion engages into the locking member, such that in the locking position, the tightening torque that is exerted by the ratchet on the serrated portion increases proportionally to the tractional force exerted on the strap in the direction of disengagement out of the locking member. Such a device provides a tightening reliability as well as an ease of quick release with one hand.

18 Claims, 3 Drawing Sheets

TIGHTENING DEVICE WITH SERRATED STRAP AND RATCHET LOCKING MEMBER

BACKGROUND OF THE INVENTION

Field of the Invention

The present invention relates to a tightening device with serrated strap cooperating with a ratchet locking member. It relates more particularly to tightening devices with which snowboard bindings with straps, roller skates, in-line roller skates, sport boots with flexible or semi-rigid upper, such as snowboard boots, hiking boots, or cross country ski boots, etc., can be equipped.

Background and Material Information

In the aforementioned devices, the object is to be able to obtain a tightening of a band or flap, made of a fabric or other flexible material, against a generally curved surface, by means of a serrated strap that meshes with a ratchet affixed to the band or flap. The band or flap is loosened by activating a lever that releases the serrated strap from the serration of the ratchet.

A major drawback of the existing systems comes from the fact that none provides both a sufficient locking reliability and a quick release of the strap out of the locking member.

In general, the torque exerted on the lever is oriented in the opposite direction at the end of the serrated strap, which has a tendency to promote the engagement of the serrated strap into the locking member rather than its quick and automatic release.

However, for a snowboard binding whose object is to retain a flexible boot on a gliding board, for example, it is important to be able to speed up the loosening of the straps, because this operation is often repeated when snowboarding, and under conditions that are sometimes difficult.

SUMMARY OF THE INVENTION

The object of the present invention is therefore to provide a satisfactory solution to the problems encountered by the prior art systems.

To this end, the tightening device according to the invention includes a strap portion provided with a serrated portion and with a tightening element, such as a band or flap, on which is mounted a locking member including:

- a base affixed on the tightening element;
- a ratchet connected to the base by a journal and having at least one complementary retaining serrated portion adapted to cooperate with the serrated portion of the strap portion;
- an elastic return means which maintains the serrated portions in contact with one another in the locking position; and
- a lever that can be actuated against the force exerted by the elastic return means for disengaging the serrated portions. The strap portion engages through the locking member, more specifically in a space provided between the journal and a complementary retaining serrated portion of the ratchet. The complementary retaining serrated portion of the ratchet is located with respect to the journal on the side where the strap portion engages into the locking member.

Thus, in the locking position, the tightening torque that is exerted by the ratchet on the serrated portion increases proportionally to the tractional force exerted on the strap in the direction of disengagement from the locking member. As a result, this ensures a locking reliability regardless of the forces exerted on the devices.

In addition, the torque that is manually exerted on the lever to disengage the serrated portions from one another, is directed in a direction that promotes the separation of the band or flap with respect to the serrated strap. It follows that the release of the device is faster and can be carried out with one hand simply by acting on the lever.

BRIEF DESCRIPTION OF DRAWINGS

The following description will help to better understand the present invention, with reference to the annexed drawings, in which.

DETAILED DESCRIPTION OF THE PREFERRED EMBODIMENTS

Figure 1:
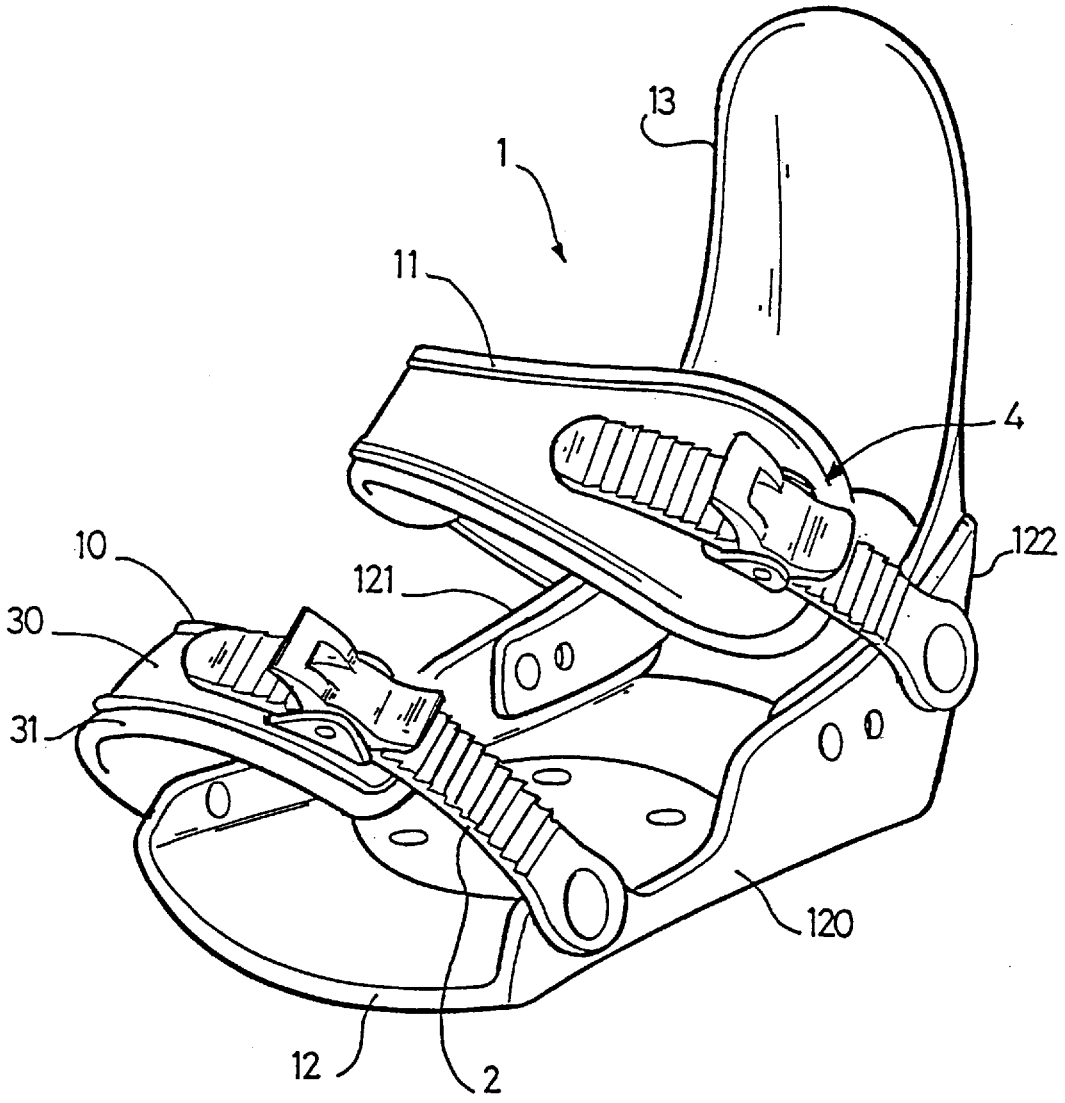
FIG 1 Prior Art
FIG. 1 is a perspective general view of the prior art devices adapted on a shell binding for snowboarding.

As shown in FIG. 1, the devices in the present application can be utilized in the field of snowboard shell bindings of which one specimen is shown by way of example.

The binding 1 includes two separated tightening devices 10, 11, one tightening device 10 serves to tighten the tip of a boot (not shown), and the other tightening device 11 serves to tighten the instep portion of the boot. Furthermore, the binding includes a base 12 on which the sole of the boot is adapted to rest, and which is extended sideward and upward by lateral edges 120, 121, and at the rear by a rigid arch 122. A rear support element 13 is journalled on the edges 120, 121, and takes support against the arch 122 to provide a rear support necessary for making turns, especially on the rear running edge of the board.

Figure 2:
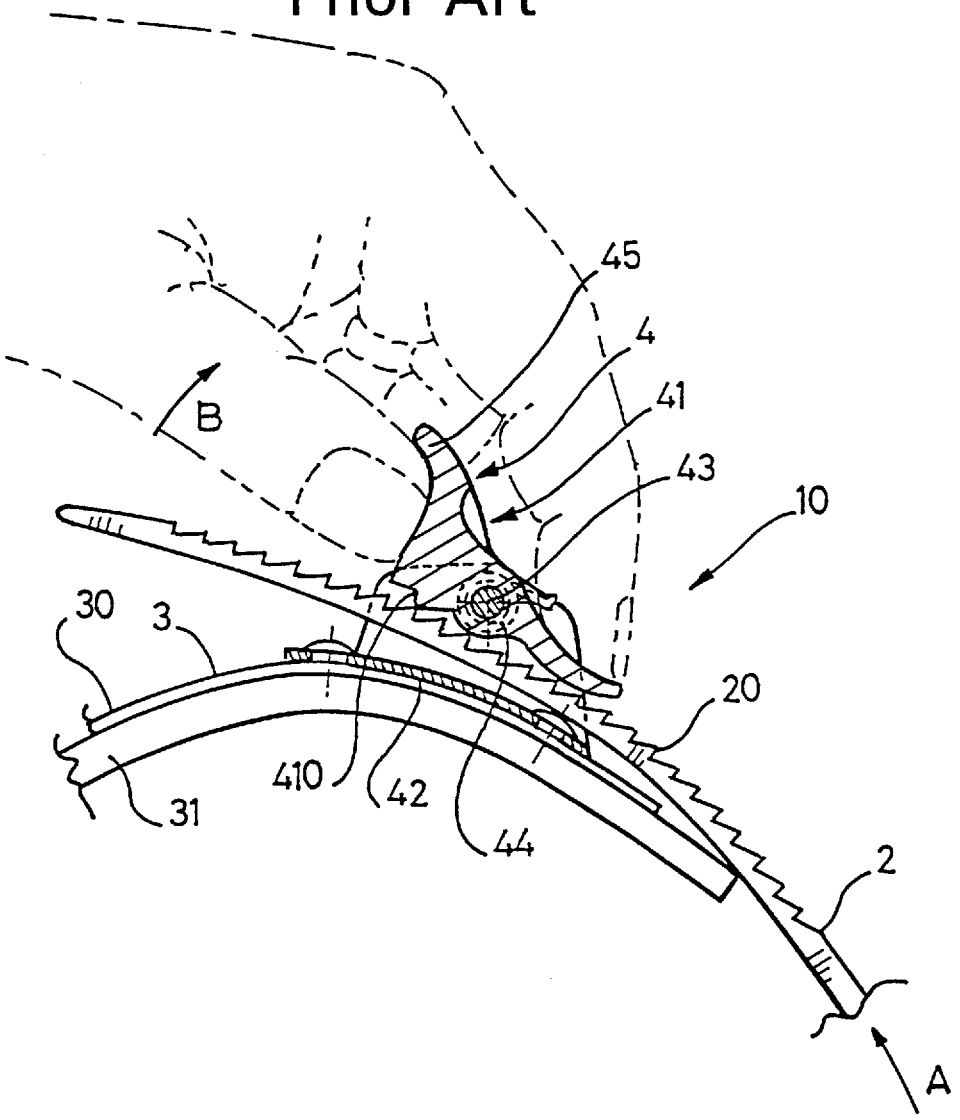
FIG 2 Prior Art
FIG. 2 is a lateral cross sectional view of a device according to the prior art.

The prior art device 10, which is illustrated by way of example and in detail in FIG. 2, includes a strap or straps portion 2 provided with a serrated portion 20 and with a tightening band 3 on which a locking assembley which includes a locking member 4, is mounted. The serrated portion 20 of the strap portion 2 of the tightening device 10 includes a series of serrations projecting form one side thereof. The strap portion 2 is fixedly attached to one of the lateral edges 120 of the binding, while the band 3 is fixedly attached to the opposing edge 121.

The band generally includes an inextensible and flexible portion 30 made of plastic, fabric or leather, and a padding portion 31 made of fabric or foam to provide comfort during tightening. As can be seen in FIG. 1, the lower surface of the tightening member or band 30 is to be applied to the surface of the boot being tightened by the tightening device.

The strap portion is made of a semi-rigid plastic so as to have a certain bending stability while being capable of assuming the curved shape of the boot.

The latching member 4 is provided with a base 42 fixed on the flap of band 3. A ratchet 41 is connected to the base by a journal 43 and includes a complementary retaining serrated portion 410 adapted to cooperate with the serrated portion 20 of the strap portion 2. A torsional spring 44 maintains the serrated portions 20, 410, in contact with one another in the locking position. Finally, the locking member includes a lever 45 that can be actuated against the force exerted by the spring 44 for disengaging the serrated portions 20, 410.

The engagement of the serrated strap portion 2 occurs in the direction A, without manual action on the lever, due in particular to the orientation of the serrations which enables a rotation of the ratchet and a lifting of the serrated portions 410. When tightening is sufficient, the engagement of the strap is stopped in a given locking position, and any return of the strap in the direction opposite A becomes impossible without manual action of the ratchet.

FIG. 2 therefore shows the disengaging manual operation which consists of acting on the lever 45 in the direction of rotation B, which spaces the serrated portions apart and enables the sliding of the strap 2 out of the locking member. As shown in FIG. 2, the torque exerted in the direction B promotes the coming closer together and overlapping of the padded band 3 and of the strap portion 2. In practice, one therefore find that it is difficult to remove the boot by a mere action on the lever, and that it is necessary to pull the serrated strap portion out of the locking member by using the other hand.

Figure 3:
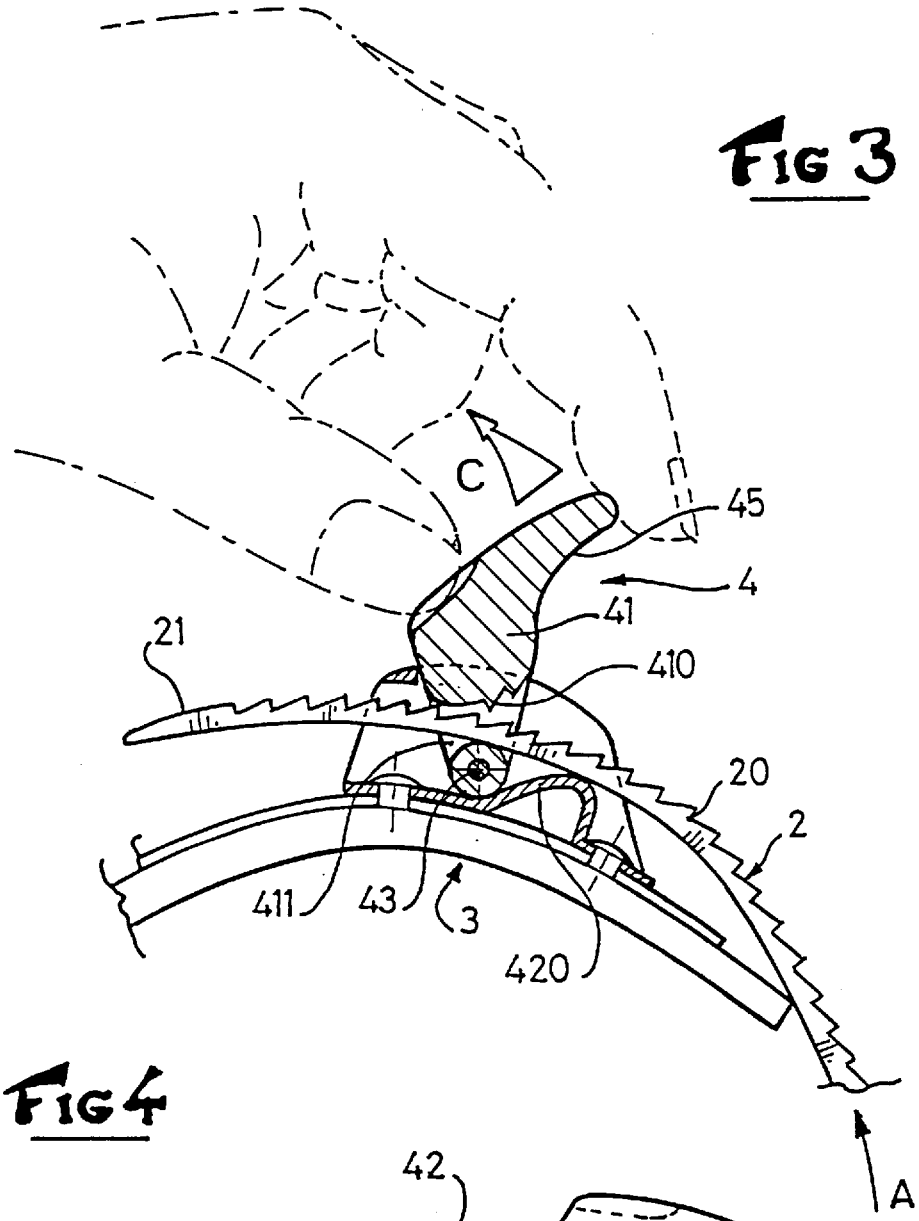
FIG. 3 is a view similar to the view of FIG. 2 for a device according to the invention.
Figure 4:
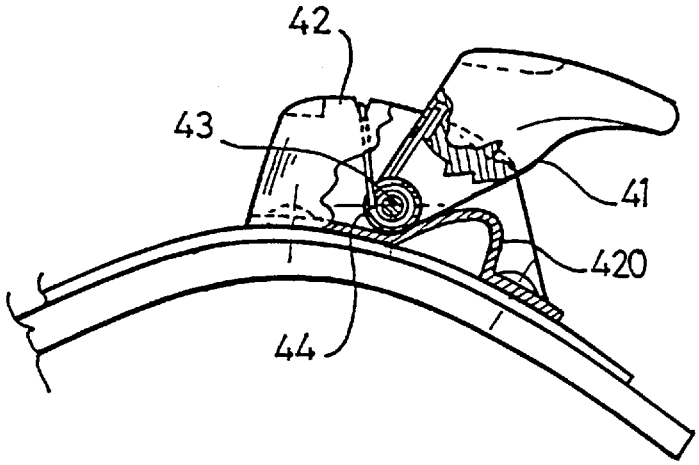
FIG. 4 is a partial cross sectional view along a plane offset with respect to that of FIG. 3 for a device according to the invention.

FIGS. 3 and 4 show the solution that is proposed by the invention in an attempt to resolve this problem while maintaining locking reliability of the device.

The device according to the invention includes, as does the prior art device, a strap or strap portion 2 provided with a serrated portion 20, having a series of serrations projecting from one side, and with a tightening band 3 overlapped by strap portion 2, on which is mounted a locking assembly, the locking assembly including locking member 4, which includes:

a base 42 fixed on the band 3;

a ratchet 41 connected to the base by a journal 43 and having at least one complementary retaining serrated portion 410 adapted to cooperate with the serrated portion 20 of the strap portion 2;

an elastic return device 44 which maintains the serrated portions 20, 410 in contact with one another in the locking position; and a lever 45 that can be actuated against the force exerted by the elastic return device 44 for disengaging the serrated portions 20, 410.

According to an essential characteristic of the invention, the strap portion 2 engages through the locking member in a space 411 provided between the journal 43 and the complementary retaining serrated portion 410 of the ratchet 41. The complementary retaining serrated portion 410 is located with respect to the journal 43 on the side where the strap portion 2 engages into the locking member 4, such that in the locking position, the tightening torque exerted by the ratchet 41 on the serrated portion 20 increases proportionally to the tractional force exerted on the strap 2 in the direction of disengagement of the locking member 4. Likewise, the action on the lever 45 is carried out in the direction of rotation C which promotes the spacing of the padded band 3 with respect to the serrated strap 2. In the embodiment shown in FIGS. 3 and 4, the lever 45 and ratchet 41 are unitary, i.e., made of a single piece.

To facilitate the introduction of the end 21 of the strap portion 2 in the space 411 of the locking member 4, the base is provided with a boss 420 at the inlet of space 411 on the side where the strap portion engages.

As shown in FIG. 4, for a minimum space requirement, the elastic return means 44 is advantageously constituted by a torsional spring 44 mounted on the journal axis 43. One of the arms of the spring is affixed to the base 42 while the other arm is attached to the ratchet 41.

The complementary retaining portion 410 of the ratchet can include a variable number of serrations; the choice of two serrations is consistent with the compromise to be made between ensuring sufficient hooking and ease of engagement.

As explained previously, such a tightening device is particularly adapted to equip a snowboard binding but is not limited to such use. One can envision such a device to be used for tightening of a sport boot, for example. In this case, the tightening element 3 can be other than a padded band. It could be a flap of any surface area, for example, capable of covering a large portion of the foot.

The materials and the number of components for making the various elements are parameters that are left to the appreciation of the one skilled in the art, as a function of specific needs in terms of space requirement, resistance, durability, weight, etc.

The instant application is based on French Priority Patent Application No. 96 07595, filed on Jun. 13, 1996, the disclosure of which is hereby expressly incorporated by reference thereto, and the priority of which is hereby claimed under 35 U.S.C. §119.

What is claimed:

1. Tightening device including a strap portion provided with a serrated portion and with a tightening element, such as band or flap, on which is mounted a locking member including:

a base fixed on the tightening element;

a ratchet connected to the base by a journal and having at least one complementary retaining serrated portion cooperate with the serrated portion of the strap portion;

an elastic return device which maintains the serrated portions in contact with one another in the locking position; and a lever that can be actuated against the force exerted by the elastic return device for disengaging the serrated portions, wherein the strap portion engages through the locking member into a space provided between the journal and a complementary retaining serrated portion of the ratchet, the complementary retaining serrated portion of the ratchet is being located with respect to the journal on the side where the strap portion engages into the locking member, such that in the locking position, the tightening torque that is exerted by the ratchet on the serrated portion increases proportionally to the tractional force exerted on the strap in the direction of disengagement out of the locking member.

2. Tightening device according to claim 1, wherein the base is provided with a boss at the inlet of the space on the side where the strap portion engages to introduce the end of the strap portion in the space.

3. Tightening device according to claim 1, wherein the elastic return device is a torsional spring mounted on the journal axis.

4. Snowboard binding, wherein it includes at least one tightening device, according to claim 1, for retaining a boot on a board.

5. Snowboard binding according to claim 4, including:

a base on which the sole of a boot is adapted to rest, and which is extended sideward and upward by lateral edges, and at the rear by a rigid arch, the strap portion being fixedly attached to one of the lateral edges of the binding, while the band is fixedly attached to the opposing edge, a rear support element journalled on the edges and taking support against the arch to provide a rear support.

6. Sport boot, wherein it includes a tightening device, according to claim 1, for tightening the foot in the boot.

7. A tightening device comprising:

a tightening member;

a strap adapted to overlap said tightening member, said strap having a series of serrations projecting away from said tightening member when said strap overlaps said tightening member;

a locking assembly affixed to said tightening member, said locking assembly comprising:

a base affixed to said tightening member;

a ratchet including at least one serrated portion complementary to and arranged for engagement with said serrations of said strap;

a journal connecting said ratchet to said base for enabling movement of said ratchet about a journal axis in either of (A) an engagement direction, favoring engagement between said serrated portion of said ratchet and said serrations of said strap, and (B) a disengagement direction, favoring disengagement of said serrated portion of said ratchet and said serrations of said strap;

an elastic return device affixed to said ratchet, said elastic return device applying a force to said ratchet directed toward movement of said ratchet about said journal axis in said engagement direction;

said ratchet further comprising an open space located between said serrated portion and said journal axis, said open space having a size adapted to receive said strap at an entry side of said open space, whereby, in said engagement between said serrated portion of said ratchet and said serrations of said strap, said strap is positioned between said serrated portion of said strap and said journal axis; and said serrated portion of said ratchet being located, during said engagement between said serrated portion and said serrations of said strap, on a side of said journal axis at which said strap is received into said open space so that, during said engagement, a tightening torque exerted by said ratchet on said serrations of said strap increases proportionally to a traction force exerted on said strap in a direction away from said open space of said ratchet.

8. A tightening device according to claim 7, wherein:

said tightening member comprises a band.

9. A tightening device according to claim 7, wherein:

a lever extends from said ratchet for manual engagement thereof to move said ratchet in said disengagement direction.

10. A tightening device according to claim 9, wherein:

said lever and ratchet are arranged with respect to each other so that a force applied to said lever during said manual engagement of said lever is directed away from said serrations of said strap.

11. A tightening device according to claim 7, wherein:

said lever and said ratchet are unitary.

12. A tightening device according to claim 7, wherein:

said base has attached thereto a boss at an inlet side of said open space of said ratchet, said inlet side of said open space being arranged to receive an end of said strap therein.

13. A tightening device according to claim 7, wherein:

said elastic return device comprises a torsion spring extending around said journal axis.

14. A snowboard binding for binding a boot onto a snowboard, said snowboard binding comprising at least one tightening device according to claim 7, wherein:

said tightening member comprises a member adapted to be positioned over an upper surface of a boot.

15. A snowboard binding according to claim 14, further comprising:

a boot base adapted to support a sole of the boot, said base further including a pair of lateral edges between which the boot is adapted to be positioned and a rear arch, said strap being connected to one of said lateral edges and said tightening member being connected to another of said lateral edges; and a rear support element connected to and extending upwardly from said rear arch of said boot base, said rear support element being adapted to provide rear support to the boot.

16. A snowboard binding according to claim 15, wherein:

said rear support element is connected to said rear arch by means of a journal connection.

17. A sport boot comprising at least one tightening device according to claim 7, for tightening the foot in the boot.

18. A tightening device comprising:

a tightening member having a surface adapted to be positioned against a thing to be tightened;

a strap adapted to overlap said tightening member, said strap having a series of serrations projecting away from said tightening member when said strap overlaps said tightening member;

a locking assembly affixed to said tightening member, said locking assembly comprising:

a base affixed to said tightening member;

a ratchet including at least one serrated portion complementary to and arranged for engagement with said serrations of said strap;

means connecting said ratcher to said base for journalling said ratchet to said base for enabling movement of said ratchet about a journal axis in either of (A) an engagement direction, favoring engagement between said serrated portion of said ratchet and said serrations of said strap, and (B) a disengagement direction, favoring disengagement of said serrated portion of said ratchet and said serrations of said strap;

means for applying an elastic return force to said ratchet in a direction toward movement of said ratchet about said journal axis in said engagement direction;

means for receiving a finger of one's hand for enabling application of a force in opposition to said elastic return force to move said ratchet in said disengagement direction;

said ratchet further comprising an open space located between said serrated portion and said journal axis, said open space having a size adapted to receive said strap, whereby, in said engagement between said serrated portion of said ratchet and said serrations of said strap, said strap is positioned between said serrated portion of said strap and said journal axis.

* * * * *